US005888960A

United States Patent [19]

Lazarowitz et al.

[11] Patent Number: 5,888,960

[45] Date of Patent: Mar. 30, 1999

[54] SURFACTANT COMPOSITION

[75] Inventors: Virginia Lazarowitz, Hatfield; Mary Frances Frazer, Phoenixville, both of Pa.

[73] Assignee: Henkel Corporation, Gulph Mills, Pa.

[21] Appl. No.: 680,895

[22] Filed: Jul. 16, 1996

Related U.S. Application Data

[63] Continuation of Ser. No. 456,445, Jun. 1, 1995, abandoned.

[51] Int. Cl.[6] ..... C11D 1/14; C11D 1/90; C11D 3/32; C11D 3/22

[52] U.S. Cl. ..... 510/502; 510/427; 510/433; 510/470; 510/499; 510/501; 510/536

[58] Field of Search ..... 510/427, 433, 510/470, 499, 501, 536, 502

[56] References Cited

U.S. PATENT DOCUMENTS

| | | | |
|---|---|---|---|
| 3,639,290 | 2/1972 | Fearnley et al. | 252/545 |
| 3,661,603 | 5/1972 | Nicol | 106/90 |
| 3,930,010 | 12/1975 | Klopping | 424/273 |
| 3,960,742 | 6/1976 | Leonard | 252/90 |
| 3,962,418 | 6/1976 | Birkofer | 424/70 |
| 4,330,613 | 5/1982 | Fickes | 430/291 |
| 4,369,240 | 1/1983 | Fickes | 430/17 |
| 4,397,941 | 8/1983 | Fickes | 430/331 |
| 4,430,468 | 2/1984 | Schumacher | 524/109 |
| 4,439,355 | 3/1984 | Kenkare | 252/541 |
| 4,477,617 | 10/1984 | Murphy et al. | 524/136 |
| 4,536,318 | 8/1985 | Cook et al. | 252/174 |
| 4,544,494 | 10/1985 | Downey et al. | 252/135 |
| 4,554,098 | 11/1985 | Klisch et al. | 252/547 |
| 4,582,636 | 4/1986 | Crossin | 252/546 |
| 4,595,526 | 6/1986 | Lai | 252/545 |
| 4,599,188 | 7/1986 | Llenado | 252/174.17 |
| 4,637,525 | 1/1987 | Miura et al. | 222/22 |
| 4,657,692 | 4/1987 | Choy et al. | 252/99 |
| 4,663,069 | 5/1987 | Llenado | 252/117 |
| 4,668,422 | 5/1987 | Malik et al. | 252/174.17 |
| 4,681,704 | 7/1987 | Bernardino et al. | 252/546 |
| 4,772,423 | 9/1988 | Pancheri et al. | 252/526 |
| 4,812,253 | 3/1989 | Small et al. | 252/132 |
| 4,820,447 | 4/1989 | Medcalf, Jr. et al. | 252/117 |
| 4,847,004 | 7/1989 | McLeod | 252/527 |
| 4,874,538 | 10/1989 | Dawson et al. | 252/117 |
| 4,948,576 | 8/1990 | Verdicchio et al. | 424/59 |
| 5,015,470 | 5/1991 | Gibson | 424/70 |
| 5,064,555 | 11/1991 | Medcalf, Jr. et al. | 252/117 |
| 5,076,953 | 12/1991 | Jordan et al. | 252/108 |
| 5,080,831 | 1/1992 | VanEenam | 252/558 |
| 5,120,532 | 6/1992 | Wells et al. | 424/70 |
| 5,132,053 | 7/1992 | Crossin | 252/546 |
| 5,136,027 | 8/1992 | Pope | 530/427 |
| 5,154,849 | 10/1992 | Visscher et al. | 252/174.15 |
| 5,158,710 | 10/1992 | VanEenam | 252/539 |
| 5,167,872 | 12/1992 | Pancheri et al. | 252/544 |
| 5,167,873 | 12/1992 | Crutcher et al. | 252/546 |
| 5,194,174 | 3/1993 | Roe et al. | 252/173 |
| 5,202,048 | 4/1993 | Bartolo et al. | 252/117 |
| 5,225,097 | 7/1993 | Kacher et al. | 252/112 |
| 5,225,098 | 7/1993 | Kacher et al. | 252/112 |
| 5,227,086 | 7/1993 | Kacher et al. | 252/112 |
| 5,230,823 | 7/1993 | Wise et al. | 252/174.21 |
| 5,234,619 | 8/1993 | Greene et al. | 252/108 |
| 5,238,992 | 8/1993 | Outubuddin | 524/710 |
| 5,242,615 | 9/1993 | Urfer et al. | 252/174.17 |
| 5,244,593 | 9/1993 | Roselle et al. | 252/99 |
| 5,258,358 | 11/1993 | Kocur et al. | 504/205 |
| 5,262,079 | 11/1993 | Kacher et al. | 252/112 |
| 5,266,690 | 11/1993 | McCurry, Jr. et al. | 536/18.6 |
| 5,284,603 | 2/1994 | Repinec, Jr. et al. | 252/546 |
| 5,290,471 | 3/1994 | Greene et al. | 252/108 |
| 5,290,482 | 3/1994 | Marschner et al. | 252/544 |
| 5,308,734 | 5/1994 | Sacripante et al. | 430/137 |
| 5,340,492 | 8/1994 | Kacher et al. | 252/112 |
| 5,370,815 | 12/1994 | Kessler | 252/106 |
| 5,378,409 | 1/1995 | Ofosu-Asante | 252/548 |
| 5,385,696 | 1/1995 | Repinec, Jr. et al. | 252/546 |
| 5,387,375 | 2/1995 | Erilli et al. | 252/546 |
| 5,389,304 | 2/1995 | Repinec, Jr. et al. | 252/546 |
| 5,389,305 | 2/1995 | Repinec et al. | 252/546 |

*Primary Examiner*—Paul Lieberman
*Assistant Examiner*—Gregory R. Delcotto
*Attorney, Agent, or Firm*—Ernest G. Szoke; Wayne C. Jaeschke; Steven J. Trzaska

[57] ABSTRACT

A surfactant composition comprising a combination of: (1) a surfactant mixture containing: (a) from about 4 to about 35 wt % actives of a linear alkyl sulfonate; and (b) from about 1 to about 20 wt % actives of an alkyl polyglycoside having the general formula I:

$$R_1O(R_2O)_b(Z)_a \qquad \text{I}$$

wherein $R_1$ is a monovalent organic radical having from about 6 to about 30 carbon atoms; $R_2$ is divalent alkylene radical having from 2 to 4 carbon atoms; Z is a saccharide residue having 5 or 6 carbon atoms; b is a number having a value from 0 to about 12; a is a number having a value from 1 to about 6, and (2) a foam additive containing a blend of: (c) from about 0.5 to about 4 wt % actives of an amide having the general formula (II):

$$R_3-\overset{\overset{\displaystyle O}{\|}}{C}-N-(R_4)_2 \qquad \text{(II)}$$

wherein $R_3$ is an alkyl group containing from about 8 to about 18 carbon atoms and each $R_4$ is the same or different and is selected from the group consisting of hydrogen, $C_{13}$ alkyl, $C_{1-3}$ alkanol, and —($C_2H_4O$—), and mixtures thereof; and (d) from about 0.5 to about 4 wt % actives of a betaine, the amounts of components (a) to (d) being based on the total actives of the surfactant composition.

20 Claims, No Drawings

SURFACTANT COMPOSITION

This application is a continuation of application Ser. No. 08/456,445 filed on Jun. 1, 1995, now abandoned.

FIELD OF THE INVENTION

This invention generally relates to a surfactant composition having exceptional foam stability. More particularly, the foam produced by surfactant mixtures based on linear alkyl sulfonates and alkyl polyglycosides can be stabilized by the addition of a foam additive containing a blend of an amide and a betaine.

BACKGROUND OF THE INVENTION

It is known that various surfactants have been found to be useful in cleaning compositions, such as shower gels, shampoos, and light duty detergents such as dish washing detergents. In these types of compositions, good foamability is a prerequisite. The most widely used surfactants in these types of compositions are anionic surfactants such as alkyl sulfates, alkyl ether sulfates, sulfonates, sulfosuccinates and sarcosinates.

Although the use of anionic surfactants in these compositions permits the attainment of desirable properties, including good foamability, the degree of foam stability leaves much to be desired. Foam stability relates to the ability of the foam, once formed, to remain intact for extended periods of time, thus enhancing the cleaning performance of the surfactant compositions.

It is sometimes advantageous to use mixtures of surfactants in cleaning compositions when the surfactans can serve different functions, e.g., one serving to improve foamability and another serving to adjust viscosity. However, known surfactant mixtures typically provide a compromise between what can be achieved with the surfactant ingredients alone. For example, a mixture of more costly surfactants such as amine oxides, betaines and alkanolamides which provide good foamability by themselves, with less expensive surfactants which provide poorer foamability will result in the formulation of a cleaning composiiton having an intermediate degree of foamability and poor foam stability.

It is therefore an object of the present invention to provide a surfactant composition having both good foamability and foam stability.

SUMMARY OF THE INVENTION

It has now surprisingly been found that a surfactant composition containing a combination of: (1) a surfactant mixture containing (a) from about 4 to about 35 wt % actives of a linear alkyl sulfonate, and (b) from about 1 to about 20 wt % actives of an alkyl polyglycoside having the general formula I:

$$R_1O(R_2O)_b(Z)_a \qquad \text{I}$$

wherein $R_1$ is a monovalent organic radical having from about 6 to about 30 carbon atoms; $R_2$ is divalent alkylene radical having from 2 to 4 carbon atoms; Z is a saccharide residue having 5 or 6 carbon atoms; b is a number having a value from 0 to about 12; a is a number having a value from 1 to about 6, and (2) a foam additive containing a blend of (c) from about 0.5 to about 4 wt % actives of an amide, and (d) from about 0.5 to about 4 wt % actives of a betaine, the amounts of components (a)–(d) being based on the total actives of the surfactant composition, provides a surfactant composition having good foamability and enhanced foam stability.

The present invention also provides a process for formulating a cleaning composition having enhanced foamability and foam stability involving combining the above-identified components in their respective amounts.

DESCRIPTION OF THE INVENTION

Other than in the operating examples, or where otherwise indicated, all numbers expressing quantities of ingredients or reaction conditions used herein are to be understood as being modified in all instances by the term "about".

THE SURFACTANT MIXTURE

The alkyl polyglycosides which can be used in the surfactant mixture according to the present invention have the general formula I:

$$R_1O(R_2O)_b(Z)_a \qquad \text{I}$$

wherein $R_1$ is a monovalent organic radical having from about 6 to about 30 carbon atoms; $R_2$ is divalent alkylene radical having from 2 to 4 carbon atoms; Z is a saccharide residue having 5 or 6 carbon atoms; b is a number having a value from 0 to about 12; a is a number having a value from 1 to about 6. Preferred alkyl polyglycosides which can be used in the compositions according to the invention have the formula I wherein Z is a glucose residue and b is zero. Such alkyl polyglycosides are commercially available, for example, as APG®, GLUCOPON®, or PLANTAREN®) surfactants from Henkel Corporation, Ambler, Pa., 19002. Examples of such surfactants include but are not limited to:

1. APG® 225 Surfactant—an alkyl polyglycoside in which the alkyl group contains 8 to carbon atoms and having an average degree of polymerization of 1.7.
2. APG® 425 Surfactant—an alkyl polyglycoside in which the alkyl group contains 8 to 16 carbon atoms and having an average degree of polymerization of 1.6.
3. APG® 625 Surfactant—an alkyl polyglycoside in which the alkyl groups contains 12 to 16 carbon atoms and having an average degree of polymerization of 1.6.
4. APG® 325 Surfactant—an alkyl polyglycoside in which the alkyl groups contains 9 to 11 carbon atoms and having an average degree of polymerization of 1.6.
5. GLUCOPON® 600 Surfactant—an alkyl polyglycoside in which the alkyl groups contains 12 to 16 carbon atoms and having an average degree of polymerization of 1.4.
6. PLANTAREN® 2000 Surfactant—a $C_{8-16}$ alkyl polyglycoside in which the alkyl group contains 8 to 16 carbon atoms and having an average degree of polymerization of 1.4.
7. PLANTAREN® 1300 Surfactant—a $C_{12-16}$ alkyl polyglycoside in which the alkyl groups contains 12 to 16 carbon atoms and having an average degree of polymerization of 1.6.

Other examples include alkyl polyglycoside surfactant compositions which are comprised of mixtures of compounds of formula I wherein Z represents a moiety derived from a reducing saccharide containing 5 or 6 carbon atoms; a is a number having a value from 1 to about 6; b is zero; and $R_1$ is an alkyl radical having from 8 to 20 carbon atoms. The compositions are characterized in that they have increased surfactant properties and an HLB in the range of about 10 to about 16 and a non-Flory distribution of glycosides, which is comprised of a mixture of an alkyl monoglycoside and a mixture of alkyl polyglycosides having varying degrees of polymerization of 2 and higher in progressively decreasing amounts, in which the amount by weight of polyglycoside having a degree of polymerization of 2, or mixtures thereof with the polyglycoside having a degree of polymerization of 3, predominate in relation to the amount of monoglycoside, said composition having an average degree of polymerization of about 1.8 to about 3. Such compositions, also known as peaked alkyl polyglycosides, can be prepared by separation of the monoglycoside from the original reaction mixture of alkyl monoglycoside and alkyl polyglycosides after removal of the alcohol. This separation may be carried out by molecular distillation and normally results in the removal of about 70–95% by weight of the alkyl monoglycosides. After removal of the alkyl monoglycosides, the relative distribution of the various components, mono- and polyglycosides, in the resulting product changes and the concentration in the product of the polyglycosides relative to the monoglycoside increases as well as the concentration of individual polyglycosides to the total, i.e. DP2 and DP3 fractions in relation to the sum of all DP fractions. Such compositions are disclosed in U.S. Pat. No. 5,266,690, the entire contents of which are incorporated herein by reference.

Other alkyl polyglycosides which can be used in the compositions according to the invention are those in which the alkyl moiety contains from 6 to 18 carbon atoms in which and the average carbon chain length of the composition is from about 9 to about 14 comprising a mixture of two or more of at least binary components of alkylpolyglycosides, wherein each binary component is present in the mixture in relation to its average carbon chain length in an amount effective to provide the surfactant composition with the average carbon chain length of about 9 to about 14 and wherein at least one, or both binary components, comprise a Flory distribution of polyglycosides derived from an acid-catalyzed reaction of an alcohol containing 6–20 carbon atoms and a suitable saccharide from which excess alcohol has been separated.

The preferred alkyl polyglycosides are those of formula I wherein $R_1$ is a monovalent organic radical having from about 10 to about 16 carbon atoms; b is zero; Z is a glucose residue having 5 or 6 carbon atoms; a is a number having a value from 1 to about 2, and most preferably is 1.4.

As was stated above, the most widely used surfactants in cleaning compositions are anionic surfactants. These surfactants have polar, solubilizing groups such as carboxylate, sulfonate, sulfate and phosphate groups which make their use highly desirable in cleaning compositions. Of the cations (counterions) associated with the polar groups, sodium and potassium impart water solubility, whereas calcium, barium and magnesium promote oil solubility. Ammonium and substituted ammonium ions provide both water and oil solubility. Triethanolammonium is a commercially important example. Salts of these ions are often used in emulsification.

Of the numerous anionic surfactants which may be employed, the present invention is specifically directed to the use of linear alkyl sulfonates. The sulfonate group, —$SO_3M$ attached to an alkyl, aryl or alkylaryl hydrophobe is a highly effective solubilizing group. Sulfonic acids are strong scids and their salts are relatively unaffected by pH. They are stable to both oxidation and, because of the strength of the C—S bond, also to hydrolysis. They interact moderately with the hardness ions $Ca^{2+}$ and $Mg^{2+}$, significantly less so than carboxylates. Modification of the hydrophobe in sulfonate surfactants, by introduction of double bonds or ester or amide groups into the hydrocarbon chain or as substituents, yields surfactants that offer specific performance advantages.

Because the introduction of the $SO_3H$ function is inherently inexpensive, e.g., by oleum, $SO_3$, $SO_2$, $Cl_2$, or $NaHSO_3$, sulfonates are heavily represented among the high-volume surfactants. While representative sulfonates include alkylarenesulfonates, short-chain lignosulfates, naphthalenesulfonates, alpha-olefinsulfonates, petroleum sulfonates, and sulfonates with ester, amide or ether linkages, the present invention is directed to the use of linear alkyl sulfonates (LAS), i. e., straight-chain alkylbenzenesulfonates in its surfactant composition. The linear alkylates thereof may be normal or iso (branched at the end only), and must have at least 10 carbon atoms.

The preferred linear alkyl sulfonates of the present invention contain a straight alkyl chain having from about 9 to about 25 carbon atoms, most preferably from about 10 to about 13 carbon atoms, and the cation is sodium, potassium, ammonium, mono-, di-, or triethanolammonium, calcium or magnesium and mixtures thereof. Suitable straight-chain alkylbenzenesulfonates include $C_{10-15}$ alkylbenzenesulfonates.

FOAM ADDITIVE

As was noted above, it was surprisingly found that the foam produced by surfactant compositions based on a surfactant mixture containing an alkyl polyglycoside and a linear alkyl sulfonate was stabilized to a higher degree by the addition of a foam additive containing a blend of an amide and a betaine.

The amides which may be employed in the present invention have the general formula II:

$$R_3-\overset{\overset{\displaystyle O}{\|}}{C}-N-(R_4)_2 \qquad \text{(II)}$$

wherein $R_3$ is an alkyl group containing from about 8 to about 18 carbon atoms and each $R_4$ is the same or different and is selected from the group consisting of hydrogen, $C_{1-3}$ alkyl, $C_{1-3}$ alkanol, and —($C_2H_4O$—), and mixtures thereof. The preferred amide is a diethanolamide.

In general, any betaine may be employed in accordance with the present invention. Specific examples thereof include ricinoleamidopropyl betaine, cocamidopropyl betaine, stearyl betaine, lauric myristic betaine, cocoamidosulfobetaine, alkylamidophospho betaine, alkyldimethylbetaines in which the alkyl group contains 8–18 carbon atoms, and the like. The preferred betaine is cocoamidopropyl betaine.

In a particularly preferred embodiment of the present invention there is provided a surfactant composition having enhanced foam stability which contains a combination of (1) a surfactant mixture containing (a) from about 6 to about 20 wt % actives of a linear $C_{1-15}$ alkylbenzenesulfonate, and (b) from about 1 to about 5 wt % actives of an alkyl polygycoside in accordance with formula I wherein $R_1$ is a monovalent organic radical having from about 10 to abut 16 carbon atoms; b is zero; Z is a glucose residue having 5 or 6 carbon atoms; and a is a number having a value of 1.4, and (2) a foam additive containing a blend of (c) from about 0.5 to about 2 wt % actives of a diethanolamide, and (d) from about 0.5 to about 2 wt % actives of a betaine, the amounts of components (a) to (d) being based on the total wt % actives of the surfactant composition. In a particularly preferred embodiment of the surfactant mixture, the alkyl polyglycoside and linear alkyl sulfonate is present in a wt % actives ratio in the range of from 1:1 to 1:7, respectively. Also, with respect to the total wt % actives of the surfactant composition, the wt % actives ratio of surfactant mixture to foam additive is preferably about 6:1, respectively.

The surfactant composition of the present invention may contain additional components which are conventionally used such as viscosity improvers, pH adjusters, colorants, pearlizing agents, clarifying agents, fragrances, preservatives, antioxidants, chelating agents, skin and hair conditioners, botanical extracts, and antibacterial agents.

The present invention also provides a process for formulating a surfactant composition having enhanced foam stability involving combining the above-identified components in the disclosed amounts.

The present invention will be better understood from the examples which follow, all of which are intended to be illustrative only and not meant to unduly limit the scope of the invention. Unless otherwise indicated, percentages are on a weight-by-weight basis.

A surfactant mixture was prepared containing 24% by weight of LAS (50% actives) and 24% by weight GLUCOPON® 625 (50% actives). A foam additive in accordance with the present invention was prepared by blending 2% by weight diethanolamide (100% actives) and 5.7% by weight cocoamidopropyl betaine (35% actives).

Table 1 illustrates the degree of foam stability imparted onto surfactant compositions 1–3 after combining 56% by weight of the above-referenced surfactant mixture with the foam additive of the present invention as compared to using only diethanolamide and cocamidopropyl betaine by themselves. All weights are based on the weight of the surfactant composition. Foam stability was measured using the following test method.

| Preparation of Test Substrates Soil Formula (400g): | |
|---|---|
| 37.5% Crisco Shortening | 150.0g |
| 12.5% Egg Powder | 50.0g |
| 50.0% 150 ppm Hard Water | 200.0g |
| | 400.0g |

(1) Whole egg powder was weighted into a bowl. Crisco was added, followed by blending until the mixture attained a homogeneous, smooth, creamy consistency. 150 ppm hard water heated to 110° F. was then added. Mixing was then performed until a smooth, uniform consistency was obtained. The pH was adjusted to 6.2–6.4.

(2) Swatches (terry cloth, med. weight) were then soiled using a syringe to deliver 1 .08g soil onto each swatch on balance. Approximately 12 swatches were prepared per surfactant composition.

(3) A 4% aqueous solution of each surfactant composition was prepared, using 10 mls to 250 ml water in a volumetric flash.

Test Procedure (1) Tergotometer was turned on and the bath was heated to 110° F.

(2) Each bucket was filled with 355 ml distilled water and 30ml of 2000 ppm concentrated hard water, calculated as $CaCO_3$=150 ppm synthetic.

(3) The agitation speed was adjusted to 75 rpm using a hand crank.

(4) Aqueous surfactant composition was added followed by agitation for 1 min. 45 sec. Agitation was then stopped.

(5) 1 swatch was added to each bucket within a 15 second period. This was repeated for every 45 secs. of agitation until the surface foam had disappeared. Each 45 sec. period was divided into 11 second intervals and an 11 second interval represents ¼ swatch.

(6) The average of 2 runs was reported and measured as the number of grams of soil needed to dissipate the foam.

| Surfactant Compsn. | %/wt. foam additive | %/wt. cocoamido-propyl betaine | %/wt. diethanol-amide | foam stability (grams of soil) |
|---|---|---|---|---|
| 1 | 2.0 | 2.0 | — | 8.1 |
| 2 | 5.7 | — | 5.7 | 9.2 |
| 3 | 7.7 | 2.0 | 5.7 | 10.2 |

As can be seen from the results obtained in Table 1 above, there exists a synergy between the amide and betaine such that once they are blended to form the foam additive and subsequently added to the surfactant mixture, a foam is formed having a significantly enhanced degree of stability, as compared to using either an amide or betaine by itself.

What is claimed is:

1. A surfactant composition comprising a combination of:

(1) a surfactant mixture containing:

(a) from about 4 to about 40 wt % actives of a linear alkyl sulfonate; and (b) from about 1 to about 40 wt % actives of an alkyl polyglycoside having the general formula I:

$$R_1O(R_2O)_b(Z)_a \qquad \text{I}$$

wherein $R_1$ is a monovalent organic radical having from about 6 to about 30 carbon atoms; $R_2$ is divalent alkylene radical having from 2 to 4 carbon atoms; Z is a saccharide residue having 5 or 6 carbon atoms; b is a number having a value from 0 to about 12; a is a number having a value from 1 to about 6, and (2) a foam additive containing a blend of:

(c) from about 0.5 to about 4 wt % actives of an amide having the general formula (II):

$$R_3-\overset{\overset{\displaystyle O}{\|}}{C}-N-(R_4)_2 \qquad \text{(II)}$$

wherein $R_3$ is an alkyl group containing from about 8 to about 18 carbon atoms and $R_4$ is ($C_2H_4OH$); and (d) from about 0.5 to about 4 wt % actives of a betaine, the amounts of components (a) to (d) being based on the total actives of the surfactant composition.

2. The composition of claim 1 wherein said components (a) and (b) are present in a wt % actives ratio of from 1:1 to 7:1, respectively.

3. The composition of claim 1 wherein said component (a) contains a straight alkyl chain having from about 9 to about 25 carbon atoms and a cation selected from the group consisting of sodium, potassium, ammonium, mono-, di-, or triethanolammonium, calcium, magnesium, and mixtures thereof.

4. The composition of claim 3 wherein said component (a) is a straight-chain alkylbenzenesulfonate having 10 to 15 carbon atoms and is present in an amount of from about 6 to about 20 wt % actives.

5. The composition of claim 1 wherein said component (b) is present in an amount of from about 1 to about 5 wt % actives and has the general formula I:

$$R_1O(R_2O)_b(Z)_a \qquad \text{I}$$

wherein $R_1$ is a monovalent organic radical having from about 10 to about 16 carbon atoms; b is zero; Z is a saccharide residue having 5 or 6 carbon atoms; a is a number having a value of 1.4.

6. The composition of claim 1 wherein said component (c) is present in an amount of from about 0.5 to about 2 wt % by weight, based on the weight of the composition.

7. The composition of claim 1 wherein said component (d) is selected from the group consisting of ricinoleamidopropyl betaine, cocamidopropyl betaine, stearyl betaine, lauric myristic betaine, cocoamidosulfobetaine, alkylamidophospho betaine, alkyldimethylbetaines in which the alkyl group contains 8–18 carbon atoms, and mixtures thereof.

8. The composition of claim 7 wherein said component (d) is cocoamidopropyl betaine and is present in an amount of from about 0.5 to about 2 wt % actives.

9. The composition of claim 1 wherein said surfactant mixture and said foam additive are present in a wt % actives ratio of about 4:1, respectively.

10. The composition of claim 1 wherein said components (c) and (d) are each present in an amount of 2 wt % actives.

11. A process for formulating a surfactant composition comprising combining:

(1) a surfactant mixture containing:

(a) from about 4 to about 40 wt % actives of a linear alkyl sulfonate; and (b) from about 1 to about 40 wt % actives of an alkyl polyglycoside having the general formula I:

$$R_1O(R_2O)_b(Z)_a \qquad \text{I}$$

wherein $R_1$ is a monovalent organic radical having from about 6 to about 30 carbon atoms; $R_2$ is divalent alkylene radical having from 2 to 4 carbon atoms; Z is a saccharide residue having 5 or 6 carbon atoms; b is a number having a value from 0 to about 12; a is a number having a value from 1 to about 6, and (2) a foam additive containing a blend of:

(c) from about 0.5 to about 4 wt % actives of an amide having the general formula (II):

$$R_3-\overset{\overset{\displaystyle O}{\|}}{C}-N-(R_4)_2 \qquad \text{(II)}$$

wherein $R_3$ is an alkyl group containing from about 8 to about 18 carbon atoms and $R_4$ is $(C_2H_4OH)$; and (d) from about 0.5 to about 4 wt % actives of a betaine, the amounts of components (a) to (d) being based on the total actives of the surfactant composition.

12. The process of claim 11 wherein said components (a) and (b) are combined in a wt % actives ratio of from 1:1 to 7:1, respectively.

13. The process of claim 11 wherein said component (a) contains a straight alkyl chain having from about 9 to about 25 carbon atoms and a cation selected from the group consisting of sodium, potassium, ammonium, mono-, di-, or triethanolammonium, calcium, magnesium, and mixtures thereof.

14. The process of claim 13 wherein said component (a) is a straight-chain alkylbenzenesulfonate having 10 to 15 carbon atoms and is present in an amount of from about 6 to about 20 wt % actives.

15. The process of claim 11 wherein said component (b) is present in an amount of from about 1 to about 5 wt % actives and has the general formula I:

$$R_1O(R_2O)_b(Z)_a \qquad \text{I}$$

wherein $R_1$ is a monovalent organic radical having from about 10 to about 16 carbon atoms; b is zero; Z is a saccharide residue having 5 or 6 carbon atoms; a is a number having a value of 1.4.

16. The process of claim 11 wherein said component (c) is present in an amount of from about 0.5 to about 2 wt % by weight, based on the weight of the composition.

17. The process of claim 11 wherein said component (d) is selected from the group consisting of ricinoleamidopropyl betaine, cocamidopropyl betaine, stearyl betaine, lauric myristic betaine, cocoamidosulfobetaine, alkylamidophospho betaine, alkyldimethylbetaines in which the alkyl group contains 8–18 carbon atoms, and mixtures thereof.

18. The process of claim 17 wherein said component (d) is cocoamidopropyl betaine and is present in an amount of from about 0.5 to about 2 wt % actives.

19. The process of claim 11 wherein said surfactant mixture and said foam additive are combined in a wt % actives ratio of about 4:1, respectively.

20. The process of claim 11 wherein said components (c) and (d) are each combined in an amount of 2 wt % actives.

* * * * *